US005671998A

United States Patent [19]

Collet

[11] Patent Number: 5,671,998

[45] Date of Patent: Sep. 30, 1997

[54] ASSEMBLY DEVICE COMBINING A CONTAINER AND A CHEMILUMINESCENT LIGHT SOURCE

[76] Inventor: Marcel Georges Collet, 57 Avenue Jupiter, 1190-Brussels, Belgium

[21] Appl. No.: 980,791

[22] PCT Filed: Aug. 30, 1991

[86] PCT No.: PCT/BE91/00061

§ 371 Date: Feb. 24, 1993

§ 102(e) Date: Feb. 24, 1993

[87] PCT Pub. No.: WO92/04577

PCT Pub. Date: Mar. 19, 1992

[30] Foreign Application Priority Data

Aug. 30, 1990 [BE] Belgium ..... 9000835
Oct. 4, 1990 [BE] Belgium ..... 9000941

[51] Int. Cl.[6] ..... F21V 33/00; F21K 2/00

[52] U.S. Cl. ..... 362/101; 362/34

[58] Field of Search ..... 362/34, 101, 84

[56] References Cited

U.S. PATENT DOCUMENTS

| | | | |
|---|---|---|---|
| 3,511,612 | 5/1970 | Kennerly | 23/252 |
| 3,539,794 | 11/1970 | Rauhut et al. | 362/34 |
| 3,576,987 | 5/1971 | Voight et al. | 362/34 |
| 4,563,726 | 1/1986 | Newcomb et al. | 362/34 |
| 4,751,616 | 6/1988 | Smithey | 362/34 |
| 5,044,509 | 9/1991 | Petrosky et al. | 372/101 X |
| 5,171,081 | 12/1992 | Pita et al. | 362/101 X |
| 5,190,366 | 3/1993 | World | 362/34 |

*Primary Examiner*—Stephen F. Husar

*Attorney, Agent, or Firm*—Lowe, Price, LeBlanc & Becker

[57] ABSTRACT

The invention relates to the use of chemiluminescent light for the illumination of liquids contained in transparent or translucent containers. The methods used are the use of reactants already mixed but preserved under very cold conditions, below −40° C., to freeze the chemiluminescence reaction and the use of chemiluminescent compounds reactivating extemporaneously at the desired moment. The two systems of use of this process are to carry it out either in the liquid to be illuminated or outside the latter.

24 Claims, 5 Drawing Sheets

FIG. 1
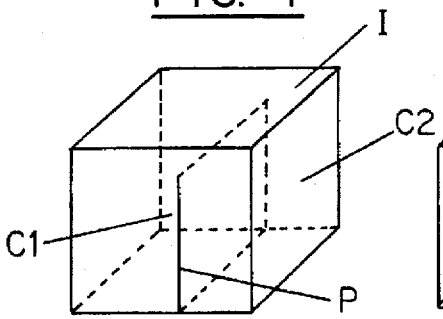
FIG. 2
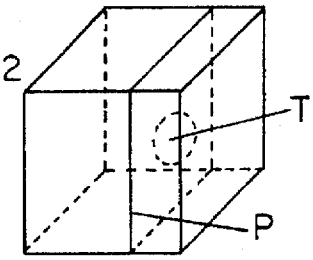
FIG. 3
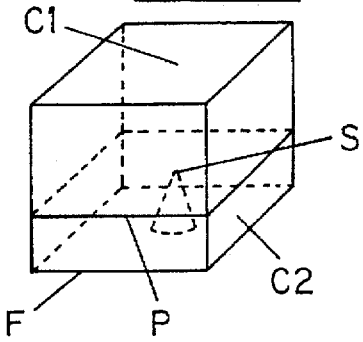
FIG. 4
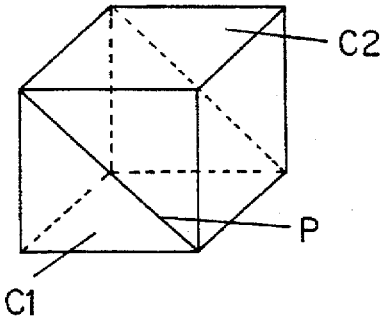
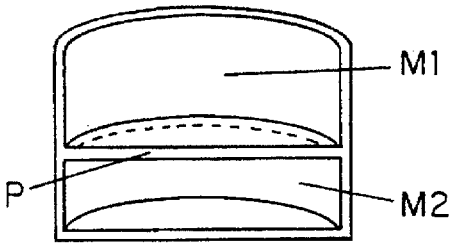
FIG. 5
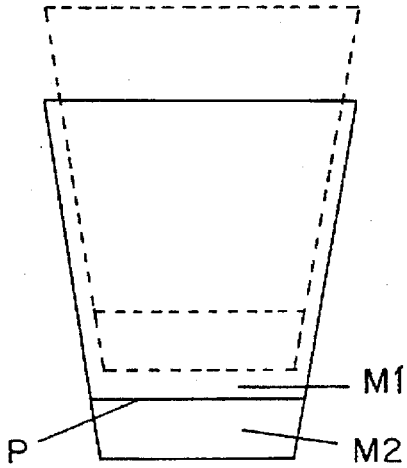
FIG. 6
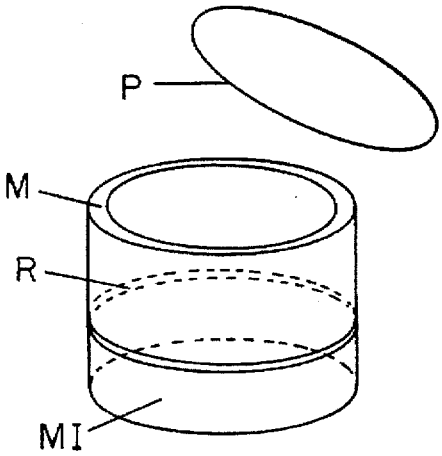
FIG. 7

FIG. 20
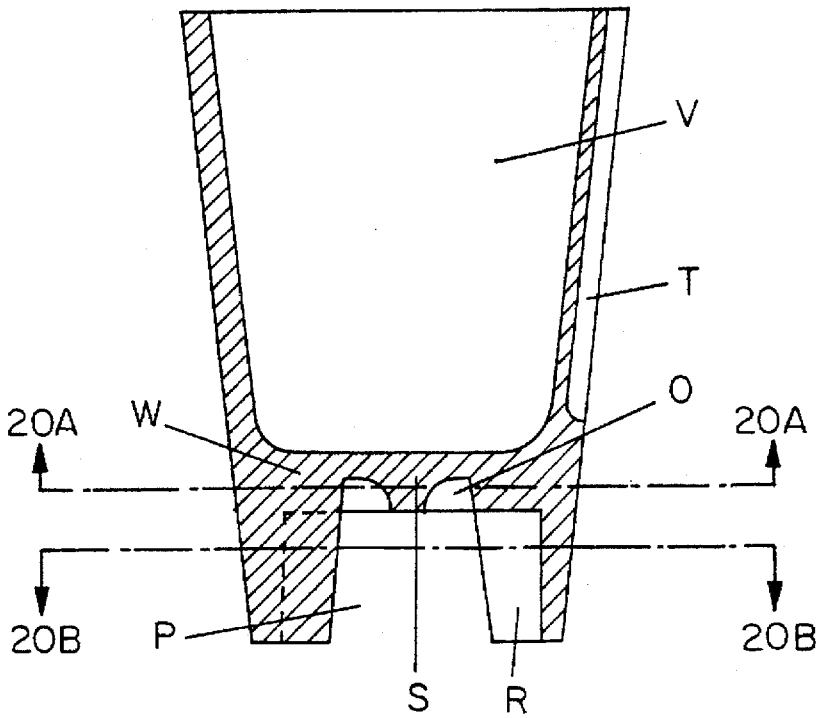
FIG. 20A
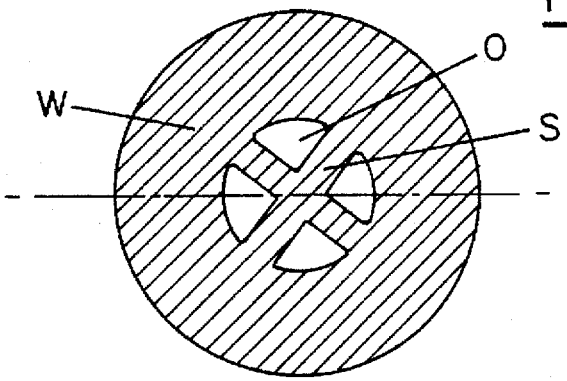
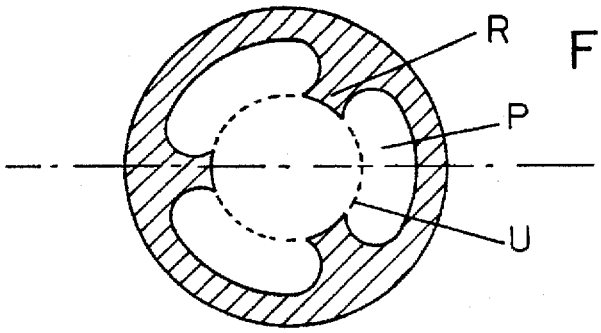
FIG. 20B

ASSEMBLY DEVICE COMBINING A CONTAINER AND A CHEMILUMINESCENT LIGHT SOURCE

The invention relates to a new use of reactants permitting the generation of a chemiluminescent light as well as devices for this use. The invention also relates to transparent or translucent containers, such as drinking glasses, bottles or vases, using this kind of device to illuminate drinks or other liquids contained in these recipients.

The principle and the techniques for the production of chemiluminescent light are fully described in numerous patents and in a considerable literature.

Chemiluminescence is produced by the reaction of an activator with a fluorescent agent and an oxalate. Within the framework of this invention, all formulae for production of chemiluminescent light are acceptable so far as the dimensions, the volume and the weight of the combination of reactants can be adapted to the devices permitting the object of the present invention to be realized.

The use is already known of electric light for the illumination of liquids contained in vases or tanks with transparent walls, such as aquariums for example; this illumination comes from a light source activated by electricity and positioned below the transparent bottom of these containers.

It would appear to be difficult and certainly not very practical to arrange an electric lamp connected to the mains supply or fed by a battery below a drinking glass or a bottle containing lemonade, beer or any other liquid.

U.S. Pat. No. 4,563,726 of 7th Jan. 1986, entitled "Illuminated chemiluminescent drinking mug", describes a means of illuminating the liquid in a mug using chemiluminescence. In order to obtain the required illumination, this system uses the chemiluminescent light produced by a light-stick device made by American Cyanamid Company, Wayne, N.J., and sold under the trademark CYALUME, which is described in U.S. Pat. No. 3,576,987 of 4th May 1971. For the purposes of using this light-stick in the device in the U.S. invention, the mug has at its centre a hollow tube which is closed at the upper end and, at the lower end, is sealed to the periphery of a circular hole in the bottom of the mug; the Cyalume light-stick is inserted through this opening; the light-stick is cylindrical in shape and, in the currently-available model, measures 3 inches or 7.5 cm. It rests on the top of the plug which serves to close the bottom end of the tube and which is located above the level of the recipient's bottom. This central tube is sufficiently large in diameter for air to circulate around the light-stick, which is therefore not in direct contact with the liquid. This arrangement of the device in this invention is necessary because the source of chemiluminescence used is a light-stick originally intended for a use other than for illuminating liquids and for which the duration of light output is from over 3 hours up to as much as even double that time; given this long period of illumination, its intensity is greatly affected if the liquid contained in the mug is very cold; hence the advantage of having air circulate between the light-stick and the tube in contact with the cold liquid so that the envelope containing the reactants (the Cyalume light-stick) is not in direct contact with the liquid and is affected as little as possible by the its lower temperature.

The drawbacks of the system are immediately apparent:

- the displeasing effect of having a long and ungainly tube in the middle of the mug which practically touches the drinker's nose when he raises the glass to drink from it; this undoubtedly affects the pleasure of drinking from an illuminated drink of this kind;
- the drawback of having the light source located just a few centimeters away from the drinker's eyes which, at its maximum intensity, can even be disagreeably bright and glaring for the drinker;

- the intensity of the chemiluminescent light is easily affected by the cold temperature of the drink—in spite of certain precautionary measures to insulate the Cyalume—owing to the large surface area of the light-stick in close proximity to the cold liquid;
- on economic and practical grounds it is necessary to use the same light-stick over a period of several hours and several refills of the mug, making it impossible from a commercial viewpoint to design a disposable illuminated glass at a reasonable price.

The invention described in this document resolves these different drawbacks by means of the system advocated as claimed in claims 1 and 2: the recipient is illuminated by means of the envelope contained the light source which is fitted within the at least partially transparent or translucid base of the recipient, as an integral part thereof, and in this way is insulated from the liquid. Furthermore, the envelope of reactants is fitted into the base in such a way that it does not encroach upon the contents of the said recipient at all.

In this description it is stated that the invention uses chemiluminescent charges specially adapted for the purpose, and not commercial models which were in fact originally intended for other purposes than that of illuminating liquids. Various devises are outlined in the following description.

In addition, by means of a appropriate doses of the different reactants, the chemical principle of chemiluminescence makes it possible to adjust the duration and intensity of illumination: accordingly it is possible to manufacture light charges with a duration of between just one and one and a half hours, the normal time for a consuming a drink. By shortening the duration of illumination, a much intenser light is obtained which is less sensitive to the cold temperature of the drink, as is the case with a light-stick such as Cyalume, whose 3-hour duration far exceeds the normal time for consuming a drink.

There are various possibilities for feeding the source of chemiluminescent light where it is necessary for illuminating the liquids contained in the containers, drinking glasses, bottles or vases. These possibilities and the devices which are created for applying them depend on the manner of envisaging the use of the combination of the chemical compounds whose reaction produces the chemiluminescent light.

There are two of these modes for the use of the chemiluminescent light:

MODE I: By putting the mixture or combination producing the chemiluminescence IN the liquid to be illuminated.

This Mode I or "Light source IN the liquid" is mentioned here for the record. This method of illuminating liquids, whether by Method A "Deep-frozen" or by Method B "Extemporaneous" will therefore not be described or a claim put forward.

MODE II: By arranging the mixture or combination producing chemiluminescence OUTSIDE the liquid to be illuminated (WHICH IS THEREFORE THE ONLY MODE DESCRIBED HERE)

There are also TWO physical methods for generation and use of the chemiluminescent light:

The first method or METHOD A consists in the use of the chemiluminescent light by the use of previously mixed reactants but with their reaction which produces chemiluminescent light frozen by conditions cold enough to do this. Indeed, it appears in the literature concerning chemiluminescent light that the reaction which generates it takes place between the limits of −40° C. and +75° C. It is possible therefore to imagine the use of the mixture already made of the reactants and its preservation beforehand at a temperature below −40° C., in carbon dioxide ice for example.

We shall call this process: METHOD A—"DEEP-FROZEN"

The second method or METHOD B consists in the use of the chemiluminescent light by the extemporaneous mixing of the reactants, which is not carried out until the moment that the light is needed.

We shall call this process: METHOD B—"EXTEMPORANEOUS"

For the purposes of illuminating liquids using the Mode "Light source OUTSIDE the liquid", various CHEMILUMINESCENT ILLUMINATION DEVICES or CHEMILUMINESCENT LIGHT SOURCES are proposed below.

A.—METHOD A

Deep-frozen

"Sources of chemiluminescent light using premixed and deep-frozen reactants"

A formula for making this application would be to create small transparent or translucid containers. These "deep-frozen small containers" which would contain the reactants already mixed would therefore be stored at a temperature below that at which the reaction starts. They could be designed so as to try to avoid, as far as possible, before their use by warming up, the mixture of reactants becoming pasty in the cold in which they are preserved (see FIGS. 1 and 2). To do this, an internal separating wall, not completely closing the two compartments by a passage in the wall (incomplete wall or hole in the wall) would permit a better preservation of the separate reactants.

The devices described above could therefore be used as a chemiluminescent charge with reactants premixed and stored deep-frozen.

B.—METHOD B

"EXTEMPORANEOUS"

1) "Sources of chemiluminescent light using reactants mixed extemporaneously"

2) "Sources of chemiluminescent light using reactants mixed controllably extemporaneously"

1) "Sources of chemiluminescent light using reactants mixed extemporaneously"

In the case in which the reactants are mixed extemporaneously, that is to say at the very moment when it is wished to obtain the production of chemiluminescent light and when the reactants, in readiness for this, are separated from each other in a completely effective way, the device should contain these two solutions in compartments that are separate but disposed and designed in such a way that one can easily, at the moment of use, cause them to communicate and bring about the mixing of the separate reactants.

An interesting concept of these "extemporaneous devices" that applies, in this case, to containers having parallel walls, that is to say in the form of cubes, right parallelipipeds or oblique parallelipipeds or in the form of regular polyhedra having at least two parallel faces, can be this: the transparent or translucent walls can be of polyethylene or polypropylene or of any other material insensitive to the reactants used; it is necessary that the material used be sufficiently flexible for the parallel walls of the polyhedron to be compressible towards each other and for the latter afterward to regain its initial shape.

The internal chamber of the "extemporaneous device" could be separated into two compartments by a wall, either of glass or of a sufficiently rigid plastic material and which can be pierced by one or more points or sharp-edged elements which could be located fixed to the internal surface of one of the external walls parallel or slightly oblique in relation to the internal separating wall, the latter possibly exhibiting zones of required fragility expressly for facilitating the piercing.

At the moment at which it is desired to cause the chemiluminescence reaction, it would suffice to press, the one towards the other, the two walls in question, of which the external one has a point or points; the internal central wall would then be pierced by the point or points and, with the two reactants mixing, the chemiluminescence reaction would be started. (see FIG. 3).

Another interesting concept is that of "extemporaneous devices" resembling the preceding ones but where the internal wall would be made of a breakable material, such as a thin glass plate or a plastic film, of a quality such that it could split or break and open under the pressure exerted on the walls, this lamina being able to exhibit zones of fragility specially required to facilitate the operation.

This separating lamina could be disposed more or less parallel between two parallel walls of the regular polyhedron, but it could also be placed obliquely between two opposite sides, for example on the internal diagonal of the polyhedron in the case of a cube (see FIG. 4).

By pushing the one towards the other, in the first case, the walls of the regular hexahedron on which the separating wall rests, and giving them slight opposite sliding movements or shearing, a breakage of the wall and the mixing of the reactants would thus be caused.

In the case of an oblique separation, the movement for breaking the wall would be that of pressing towards each other the two sides of attachment of the internal wall and making them move slightly relative to each other.

In the case of "extemporaneous devices" which were not regular polyhedric in form, the process of separation of the two chambers by a partition which can be punctured by means of one or more points situated on a more or less parallel external wall cannot be imagined for all forms of volumes or of polyhedra, although it would be realizable in many cases; on the other hand, the process of the breakable wall in glass or in brittle material or of a structure which can crumble under pressure can apply to all the forms of "extemporaneous devices".

Another type of "extemporaneous device" consists of a small container formed from two compartments containing the reactants whose separating wall has a hole plugged by a stopper coupled to a control rod, the assembly having the appearance of a piston; the control rod of the stopper leaves the container by sliding in a tube internal to the compartment and integrally attached to the external wall from which it leaves. By pressing this rod, the communicating hole between the two compartments is unplugged and the mixing of the reactants is thus permitted. (see FIGS. 17 and 17A).

2) "Sources of chemiluminescent light using reactants mixed controllably extemporaneously"

The source of chemiluminescent light using reactants mixed extemporaneously, the concept of which has just been explained, can be modified to become a model "unscrewable extemporaneous device" by threading the control rod of the stopper; this permits it to be made screwable and unscrewable in the tube, also threaded, which supports it; the stopper, after having unplugged the communicating hole between the two compartments, can thus be enabled to return and to replug the hole which it has just left; this operation permits the mixing of the reactants to be controlled. In order to permit the reengagement of the stopper in the orifice which it has just left, it is desirable that the stopper be spherical in shape or has the form of a double cone integrally attached at the base. (see FIG. 18).

Another, equally interesting concept is that in which the small container is also made of two compartments containing the reactants to be mixed, separated by a wall in which a hole is provided. This hole is closed by a stopper that is spherical in shape or has the form of two cones integrally attached at the base, a stopper through which there passes a rod of which the central portion is threaded, the interior of the channel in the stopper through which the rod passes itself also being threaded. By turning this partially threaded rod, the closing sphere or double cone is raised or lowered, and the mixing of the reactants causing the chemiluminescence reaction is thus permitted. The end of the lower part of this rod turns freely in a cavity made in a local reinforcement of the internal face of the lower wall, while the upper part of the rod, at its end which emerges from the upper wall, level with the surface, presents a button-shaped widening which permits it to be turned or simply presents a slot in which the edge of a coin can be introduced in order to turn it. The upper end of the rod, which is not threaded, turns in a sleeve attached to the upper wall, the sleeve supporting it and permitting an improved airtightness of the container. In order that the column does not rise back up when it is unscrewed and, turning in the threading of the stopper which would be fixed too firmly, does not leave the cavity where its lower end turns freely, ridges are placed on the upper part of the rod just below its point of entry into the smooth sleeve, causing the threaded spindle to remain in place and the stopper to leave the hole which it is closing. (see FIG. 19).

Another interesting "extemporaneous device" concept would be the following: this is an extemporaneous chemiluminescent device consisting of a small container having the form of a short cylindrical column or of square or polygonal section and of volume such that it could be thrown into a drinking glass. The assembly is in fact a small transparent or translucent bottle, closed by a stopper which has the same cross-section and the same external diameter as the basic bottle which it extends upwards. Inside the bottle a partition completely separates the bottle into two compartments containing the reactants. In the middle of it there is a neck into which screws the threaded part of the stopper. This neck is open downwards and this bottom opening of the neck consists of two semicircular orifices separated by the top of the upper edge of the internal partition on which the base of the stopper settles when it is closed. The impossibility of communication between the two compartments and the isolation of the reagents from each other, is realized by the close contact and pressure of the base of the stopper on the top of the separating partition. When the stopper, whose threaded part is sufficiently high that it does not entirely leave the neck, is unscrewed, an expansion chamber is provided in which, if the device is inverted, the reactants can mix. By shaking the bottle, the mixing of the reactants and their chemiluminescence reaction is accelerated. When the latter is taking place and the two reactants are well mixed and distributed in the two compartments, the stopper can be screwed up, thus reforming a luminous "unscrewable extemporaneous imitation ice cube". (see FIGS. 15 and 15A)).

A characteristic of these "unscrewable extemporaneous device" devices is that the mixing of the reactants can be initiated, the reaction allowed to start, the communicating opening closed again and, if desired, the reaction prolonged by unscrewing the stopper again and allowing the reactants to mix again.

It is also possible to leave the stopper slightly open in such a way that the reactants mix progressively, thus making it possible to obtain a prolonged reaction and an intensity more regular and more constant than when the reactants are mixed suddenly on a single occasion, which gives a very intense initial luminescence reaction, followed by a lesser luminescence.

In the case of the last "unscrewable extemporaneous device" of cylindrical section, the stopper part can have a diameter a little wider than the bottle part; this edge can extend around the bottle section to form a small circular skirt. The latter continues to cover the empty space left between the bottle and the stopper when the latter is slightly unscrewed and kept in this position to allow a slow reaction.

To permit an absolutely complete airtightness of the device towards the exterior when the stopper is closed again onto the bottle, the edges of the stopper and bottle can be designed in such a way that when they make contact the intimacy of contact is perfect: this can be done especially by increasing the contact surface, either by bevelled edges or by convex edges opposite to concave edges or by any other section design corresponding to a design opposite.

The modifications and adaptations which can be applied equally well to the "Deep-frozen devices" as to the "Extemporaneous devices" are set out below:

The wall of the "devices" can be coloured either in the mass or superficially to modify the colour caused by the chemiluminescence; this wall can also bear different designs of different colours.

The "devices" can also bear inscriptions, advertising marks or logos, either in relief, or recessed, or printed.

The interior of the walls of the "device"—in order that the internal light illuminates still better the thickness of the transparent or translucent wall, and possibly the illustrations in relief or recessed which they may bear—can have edges with extremities such that they take the internal light and transmit it inside the thickness of the wall.

For a really good commercial utilization, the preferred model would be that in which the luminous life of these "imitation ice cubes" did not exceed the normal time of consumption of a drink. This duration can easily be regulated by an expedient dosage of reactants.

SUMMARY OF SYSTEMS USING THE MODE "LIGHT SOURCE OUTSIDE THE LIQUID"

A.—METHOD A

"DEEP-FROZEN"

Device integrated in the container:

B.—METHOD B

"EXTEMPORANEOUS"

a)—Device independent of the container:

b)—Device integrated into the container

RECIPIENTS INTENDED TO CONTAIN THE LUMINOUS CHARGES

A.—METHOD A

"DEEP-FROZEN"

Chemiluminescent device integrated in the container:

1) Jackets (with chamber containing mixed and deep-frozen reactants) for fitting of tumblers, bottles and vases.

2) Recipients (with chamber containing mixed and deep-frozen reactants).

1) Jackets (with chamber containing mixed and deep-frozen reactants) for fitting of tumblers, bottles and vases.

In the systems permitting the use of METHOD A of generation of the chemiluminescent light, that is to say when a solution already mixed but deep-frozen is used, an expedient device to obtain the illuminating effect at the moment when the product returns to the normal temperature is a jacket whose lower part, closed by a partition, constitutes a chamber containing the deep-frozen mixture: this airtight chamber is separated from the open upper part, intended to receive the glass or the bottle or the vase, by a partition allowing the passage of light, either in glass or in plastic or in any other transparent or translucent material.

It is desirable that the coating of the internal surface of the jacket be either of a light colour or as reflecting as possible so that the chemiluminescent light generated be propagated to the maximum in the direction of the liquid which the container contains.

For a still better illumination, it is possible to imagine that the lower part of the chamber of the jacket has a hemispherical shape or is in the form of a parabolic mirror which would reflect the maximum of light towards the liquid to be illuminated.

These jackets can be of round or polygonal section or of any other design provided they are intended for containers which correspond to them.

They can be of cross-section constant over their height, either tapered or in the form of a truncated pyramid for easier storage, since with this latter design they can be stacked easily above each other and constitute a reduced volume during their preservation—before use—at an extremely low temperature which freezes their reaction. In this last case, the containers which are fitted into them must have the same tapered or truncated pyramidal configuration.

These jackets can bear grooves or ridges to keep the containers firmly in the jackets and avoid, for example with regard to the tumblers, the consumers easily dismantling the assembly in order to recover the light source.

These jackets, as has just been described, can be fitted equally well with tumblers as with bottles or vases.

2) Recipients (with chamber containing mixed and deep-frozen reactants):

The jackets which have just been described can also become jacket-beakers, that is to say, jackets which extend upwards by a transparent or translucent part sufficiently firm to constitute a beaker or a drinking glass. It would be a question at this moment of beakers for once-only use; in the coupled bottom, forming an integral part of the actual structure of the assembly, there would be placed the mixture of the reactants, the assembly being kept at a temperature low enough to freeze the reaction of chemiluminescence.

As for the preceding jackets, these beakers can be designed in such a way that they are stackable, one above another, to occupy less volume during their storage at low temperature. (see FIG. 6)

The transparent or translucent separating wall between the compartment containing the product of mixing of the reactants can carry inscriptions or logos or also show a structure in relief and/or possibly coloured, intended to cause luminous effects in the liquids above.

B.—METHOD B

"EXTEMPORANEOUS"

a)—Chemiluminescent device independent of the container:

1) Empty jackets (with lower receiving chamber) for containers to be fitted

2) Recipient (with lower receiving chamber)

3) Bottles (integrally attached assembly with bottom jacket)

4) Recipients (integrally attached assembly with bottom jacket)

5) Containers with hollowed-out thick bottom

6) Jackets with hollowed-out thick bottom

1) Jackets (with lower receiving chamber) for containers to be jacketed

The existing systems or the devices described above, such as those also called "extemporaneous imitation ice cubes", which themselves contain the reactants in two compartments, separate but contiguous and designed in such a way that an easy operation brings the reactants together, can constitute, with others already existing on the market, the devices which will give the chemiluminescent light in this particular concept of the present invention.

The basic system consists of a jacket whose bottom is in the form of a chamber that can contain the chemiluminescent device for extemporaneous mixing (see FIG. 5).

The jacket can be cylindrical or square or have any polygonal section as well as any diameter, so far as it is adapted as well as possible to the container which will be introduced to its upper part.

When the chemiluminescent device is introduced at the top of the jacket, the glass can be placed directly on this device so far as the glass and the jacket form one body together satisfactorily and perfectly correspond with each other in shape.

An improvement of this jacket open solely at the top would be a jacket showing a thickening of its lower wall or having a continuous ledge or ridges or asperities on the internal circumference so as to support the transparent or translucent container which would be placed there. This ledge or these internal ridges would also permit transparent or translucent plates insulating the chemiluminescent device of the container itself to be supported. These plates could be coloured or bear all kinds of advertising or other notices. (see FIG. 7)

An effective development of this jacket, designed to give the best possible illumination of the liquid present in the container which is jacketed therein, is for its lower internal part to have a shape and a covering as reflective as possible: a form of parabolic mirror, for example, would direct the maximum of chemiluminescence towards the liquid to be illuminated.

The chemiluminescent device can also be introduced by the bottom of the jacket. Consequently a variant would be for the jacket to be divided into two parts separated by a transparent or translucent wall on which, when the container fits into the open upper part of the jacket, the bottom of the container would sit. The lower part of the jacket below this separating wall would constitute the space in which the chemiluminescent device would be accommodated.

It is not absolutely necessary that this space be closed, provided that the chemiluminescent device which is placed there has a diameter such that it can jam there by its own elasticity. The interior of the periphery could, moreover, have a circular shelf, either at its bottom edge or at the height of its wall or again ridges which could better fix the luminous device and aid in collecting the light towards the walls.

An effective development of the preceding model, which permits the dispersion of the light by the bottom—which is not very attractive—to be avoided is that which provides a removable bottom to be placed in this lower part of this model of jacket in order to prevent the luminous device from falling. This bottom can be fixed by threading or pressure or by any other means; it can fold up and down and be attached to the bottom of the jacket by a hinge. This bottom could impede—to a certain degree—the dismantling of the assembly of jacket and tumbler by an inquisitive consumer of the drink. (see FIG. 8).

It is desirable but not necessary that this jacket has an opaque covering or is made of a translucent material so that in the space reserved, the details of the activated luminous device are not distinguished.

2) Recipient (with lower receiving chamber)

a.—It is obvious that the upper part of the preceding jacket can serve as a beaker. An embodiment of this kind would be that of a drinking beaker in transparent or translucent material, able to transmit light, which would have a bottom provided with a recess with a vertical axis, open at the bottom but capable of being closed by a base which would fit there. This recess would be capable of accommodating a chemiluminescent light source in the form of a container of cylindrical or any other section, its own cross-section having to coincide with that of the container in question. This container would keep itself in place by its own elasticity against the lateral walls of the recess, which would have ridges exerting a positive pressure against the container, so as to assure its support and collect its light. The wall which separates the recess from the cavity of the beaker containing the drink would itself also be provided with ridges intended to enter into intimate contact with the container and also to collect the light in order to propagate it in the walls.

The wall of the zone of the beaker containing the drinking liquid could be used to place there a trade mark or a logo; it would thus be provided outwardly with a recessed shoulder by the fact that the wall of the said zone would be thicker at the bottom than at the top, with a sudden reduction; this shoulder would therefore be the bearer of an advertising text engraved in positive or negative relief and this shoulder could affect the whole circumference of the beaker or only a part thereof. The bottom of the beaker could be fabricated in such a way that it exactly encloses the lower edge of the container, so that on inserting the latter into the recess it would be necessary gently to force a tight passage at the base and that once the container is introduced into the recess it cannot be withdrawn; the assembly of beaker and chemiluminescent charge then truly constitutes a non-dissociable assembly (see FIGS. 20, 20A and 20B).

b.—A design that would also permit a close association of the luminous charge would be that in which the recess in the bottom of the glass described above would be designed as a threaded cavity into which there would screw the chemiluminescent element, whose shape and external volume would represent a thick, short screw. This element could be screwed because the surface of the external face of its base would bear a slot into which the edge of a coin could be introduced or a special recessed design corresponding to an appropriate key which would ensure that only the barman of the establishment in which this type of drinking glass would be used could possibly unscrew the chemiluminescent element from the threaded recess into which it has been introduced. In order to avoid too easy a withdrawal of this chemiluminescent element by an inquisitive customer, a safety lock of the element could operate at the moment the latter is screwed down. In this design of chemiluminescent tumbler element the contact between the threads of the screw that the chemiluminescent element represents and of the recess of the bottom of the beaker is very close and allows perfect collection of the light to be transmitted into the walls of the beaker.

In order the better to guard against or to avoid as much as possible a loss of light, it would be possible to cover the ridge constituting the upper edge of the beaker with a reflecting layer.

3) Bottles (integrally attached assembly with bottom jacket):

The upper part of the jackets described above can be extended upwardly to form a container constituting a bottle closed by a stopper.

In this concept of jacket-bottle, an interesting adaptation of the invention applies more particularly to certain bottles in plastic of lemonade or mineral water sold commercially whose rounded bottom is provided with a cylindrical jacket glued at its centre which permits the bottles to be kept in a vertical position, the jacket being called a "base cup". Since an empty space exists between the rounded bottom of the bottle and the wall of the jacket, it is possible to make one or more holes in this wall and to slide into them one or more activated chemiluminescent sticks which would illuminate the contents of the bottle. (see FIG. 9)

To close the hole or holes it is possible to provide one or more closing plugs, which, blocking the hole or holes, after having been removed to allow the activated luminous stick or sticks to pass, could then be replaced there and losses of light prevented.

Another form of entry of the holes of the jacket could be made of one or more incisions, star-shaped or of any other pattern, which would allow the luminous stick or sticks to pass and would close again on them after their introduction.

This concept of the invention, of a bottle with a bottom which does not entirely fill the jacket which surrounds it, can be applied to bottles having bottoms of various shapes so far as the latter leave, between them and the jacket serving as base, a space into which luminous sticks for illuminating the liquid can be slid.

4) Recipients (integrally attached assembly with bottom jacket)

As for the jacket-bottles described above, it is evident also that the concept of the plastic jacket (base-cup) glued onto a rounded bottle bottom can also be applied to the jacket-beakers which would have the same base, with other dimensions, as the bottles described above, but whose top would form a tumbler instead of being a bottle closed by a stopper.

Here also, the modifications brought to the jacket of the bottle with rounded bottom are applicable: these are among others, holes in the wall and better reflectivity.

A variant of these beakers is that in which the lower rounded chamber would be closed by a plate allowing the light to pass in such a way that one would have a beaker whose internal bottom, supporting the liquid, would be flat. (see FIG. 10)

5) Containers with hollowed-out thick bottom:

Another interesting concept is that of a transparent or translucent container whose thick bottom has a space in order that the chemiluminescence-producing device can be slid therein. This could be a hollowed-out hole or a drilled tunnel into which there could be slid the luminous stick, whose thickness, corresponding to the diameter dimension of the hole, could jam there, thanks to the elasticity of the envelope of the luminous stick. The opening or openings of this hole or these tunnels could be closed by appropriate stoppers. (see FIG. 12)

6) Jackets with hollowed-out thick bottom:

This latter concept can also apply to jackets having a thick, transparent and translucent bottom with a hollowed-out hole or drilled tunnel, a jacket into which the container containing the liquid to be illuminated could be fitted. (see FIG. 11)

B.—METHOD B

"EXTEMPORANEOUS" (Continued)

b)—Chemiluminescent device integrated into the container:

1) Jackets (for containers to be fitted) with two closed lower compartments each containing one of the reactants 2) Recipients and bottles with two closed lower compartments each containing one of the reactants 1) Jackets for containers with two closed lower compartments each containing one of the reactants:

The jackets of this concept consist of an upper open space representing the part of the jacket into which the container whose liquid must be illuminated will be fitted, and a lower chamber comprising two compartments separated by a wall, each of which contains one of the reactants.

The floor of the base of these jackets must consist of polyethylene or polypropylene or of any other plastic material showing the same advantages and which is sufficiently flexible to be pushed gently toward the interior or to be able to sustain a lateral horizontal movement.

One concept of this system would be that which is described below: the two lower compartments of the jacket are superposed. They are separated by a partition which is either horizontal or slightly oblique (inclined) in an impermeable but sufficiently rigid material; the floor of the lower chamber, which constitutes the bottom of the jacket, is provided on its internal surface with one or more pointed ridges which, when the bottom, which is sufficiently flexible for the purpose, is pushed upwards, cause the point or points of the internal face to break the separating partition, which could have at the corresponding places zones of fragility desired beforehand; this operation permits the two reactants to mix. (see FIG. 13).

A variant of this system is that in which the two compartments each containing reactants are separated by a vertical or oblique partition. This partition is breakable. The fact of pushing on the flexible bottom or of giving it a shearing movement breaks this partition and permits the reactants to mix. Here also a zone of fragility in the separating wall could have been provided. (see FIG. 14)

2) Recipients and bottles with two closed lower compartments each containing one of the reactants:

These beakers constitute a variant of the preceding jackets, given that their upper part extends in the form of a transparent or translucent drinking glass. The material chosen for the fabrication of these jacket-beakers must be rigid enough to constitute drinking tumblers.

Apart from differences due to their use in extemporaneous reaction and the differences in their actual constitution for this usage, the modifications and adaptations as regards their shape, their colours, and their advertising and other advantages are the same as those which are described for the deep-frozen jacket-beakers and those with external chemiluminescent device described above.

This concept explained above applies to beakers for once-only use. It can apply in the same way to jackets extended into bottles.

Illuminating bases for transparent or translucid objects to be illuminated:

If it is considered that the height of the upper part of the jacket can be reduced to the maximum or, in other words, its internal depth reduced to the maximum, there is thus obtained, from the different kinds of jackets which have been described above, devices constituting in fact—if desired—supports with luminous surface permitting various containers to be illuminated, such as perfume bottles in shop windows, for example.

General comment regarding the invention:

The devices which have been described in the description above, like the others to which one or other of the claims mentioned below would apply, will achieve the actual object of the invention, that is to say the illumination of liquids contained in transparent or translucent containers, and more particularly in drinking glasses.

It is evident that the quality of this illumination is going to depend on a certain number of factors which are foreign to the essential conditions of the invention and which are modifiable at the moment it is made use of, according to the choices and decisions of its executant.

The latter are among others—and not exhaustively or in an order of preference—the intensity of the chemiluminescence, the volume of the container and of the liquid to be illuminated, the reflectance of the internal wall of the chamber containing the chemiluminescent device, the nature of the walls of the container containing the liquid, the physical and chemical nature of the latter, its colour and the compatibility of the latter with that emitted by the luminous device.

Thus, for example, to illuminate a tumbler will require less luminous intensity than that required by a large bottle; in the same way, a chemiluminescent device which illuminates a tumbler satisfactorily will illuminate a much larger bottle only poorly.

The quality of the illumination of a liquid will depend also on its composition: a simply coloured solution will light up better than a lemon drink containing fruit pulp in suspension. Likewise, certain colours produced by chemiluminescence will go badly with those of solutions that in some way neutralize them: a green chemiluminescence, for example, on a red drink. On the other hand, a drink containing fine reflecting flakes, such as certain liqueurs have, will give a very pleasant luminous effect. Also, not too intense an ambient illumination of the spot where the illuminated solution is situated is clearly a prime success factor for the agreeable effect of the invention.

FIGURES

The methods explained above apply to particular apparatuses or devices permitting the present invention to be made use of; by way of non-limiting examples they are taken up again in the figures accompanying certain of the descriptions of the invention.

FIG. 1 is a three-dimensional view of a small deep-frozen and airtight container which would here have a cubic shape. This is intended to contain, in two separate compartments C1 and C2, each of the deep-frozen reactants. The internal wall P separates the latter in order to avoid their contact and their reaction at a temperature where they could react again and cause chemiluminescence to begin. The wall P leaves a free passage I towards the top of the cube at the moment of its closure. The container being deep frozen, it is at the moment of its reheating that the liquids can enter into contact and mix by the aperture permitting communication between the two compartments C1 and C2.

FIG. 2 is a three-dimensional view of a small deep-frozen and airtight container resembling that of FIG. 1, but in which the internal wall P is pierced by a hole T to permit the passage of liquids when they start to warm up again.

FIG. 3 is a three-dimensional view of a small airtight container, here in the form of a cube, where the reactants to be mixed extemporaneously are kept in two compartments C1 and C2 separated by a rigid wall P that can be pierced by a point S that is situated on the inside of the flexible bottom F of the cube.

FIG. 4 is a three-dimensional view of a small airtight container, here in the form of a cube, where the reactants to be mixed extemporaneously are kept in two compartments C1 and C2 separated by an oblique wall P, breakable by a shearing movement of the relatively flexible walls of the cube.

FIG. 5 represents the section in three dimensions of a jacket whose open upper space M1 is intended to receive the bottom of the recipient or tumbler or the bottle to be illuminated and whose lower chamber M2 contains the deep-frozen luminescent liquid, the two parts M1 and M2 being separated by a wall P which allows the light to pass.

FIG. 6 represents a diagrammatic view of a conical jacket-beaker consisting of an open upper space M1 forming the beaker and a closed internal chamber M2 containing the mixed and deep-frozen chemiluminescent liquid, the two parts M1 and M2 being separated by a wall P which allows the light to pass. In dotted lines, a similar jacket-beaker is fitted into the first to show that it is possible thus to stack them and to store them in a relatively small volume.

FIG. 7 represents in three dimensions an open jacket M having an internal shelf R on which the bottom of the tumbler or of the bottle sits, with the possibility of previously setting down a plate P which allows the light to pass, thus creating a lower chamber M1 in which the activated chemiluminescent device is placed.

Figure 8:
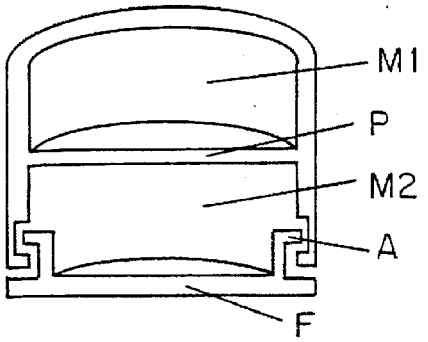

FIG. 8 represents a three-dimensional section of a double jacket made of two compartments M1 and M2, the one, M1, receiving the bottom of the recipient or tumbler, of the bottle or of the vase and the other, M2, for receiving the chemiluminescent device for extemporaneous mixing; M1 and M2 are separated by a wall P which allows the light to pass; the lower chamber M2 is closed by a bottom F fixed by the ridges A lodged in the wall of the jacket.

Figure 9:
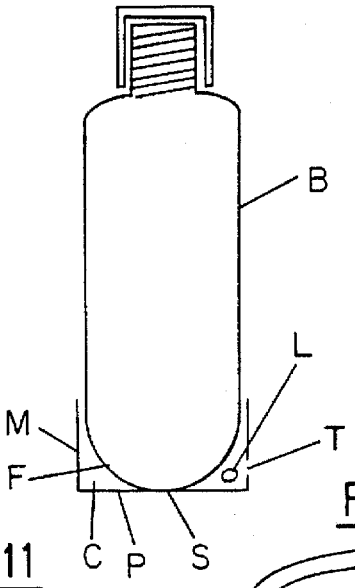

FIG. 9 represents in diagrammatic view a commercial plastic bottle B with rounded bottom F attached at the point S to a jacket M which hugs it closely so as to hold it vertical, by its flat bottom P, this jacket here being pierced by a hole T by which the chemiluminescent lightstick L can be introduced into the chamber C left empty between the rounded bottom F of the bottle B and the cylindrical wall of the jacket.

Figure 10:
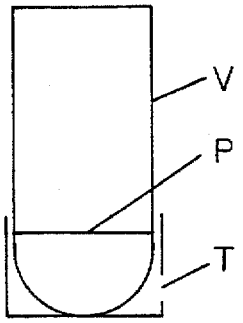

FIG. 10 represents a diagrammatic section of a recipient or tumbler identical to FIG. 9 except for the upper part (B in FIG. 9) which is replaced here by an open chamber making the tumbler V; the latter is possibly separated from the rounded bottom by a wall P which allows light to pass.

Figure 11:
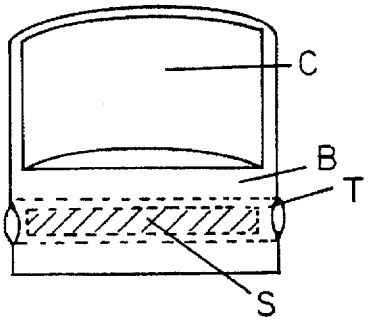

FIG. 11 represents a section in three dimensions of a jacket containing an open upper chamber C intended to receive the bottom of the recipient or tumbler or of the bottle and through whose base B, which is thick and allows the light to pass, there is here bored a tunnel T, into which the chemiluminescent stick S can be slid.

Figure 12:
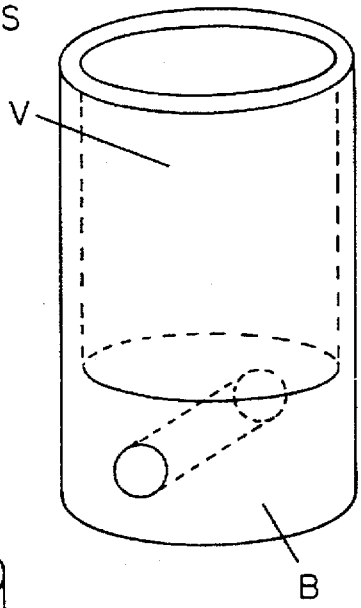

FIG. 12 represents diagrammatically in three dimensions a recipient or tumbler whose base B is identical to that of FIG. 11, but whose upper part V constitutes a drinking glass.

Figure 13:
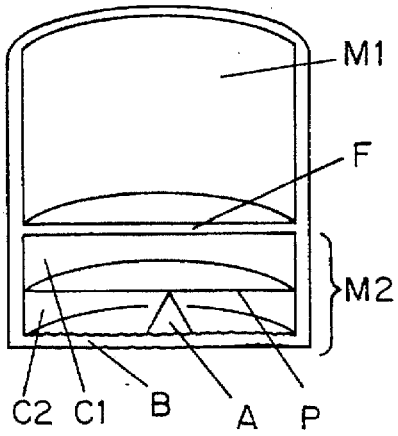

FIG. 13 represents a section in three dimensions of a jacket whose upper open part M1 is intended to receive the bottom of the container to be illuminated and is separated by a wall F allowing passage of the light coming from the lower part M2, consisting of two compartments C1 and C2 containing the reactants and separated from each other by a wall P, that can be punctured or broken by a point A situated on the impermeable flexible base B of the jacket.

Figure 14:
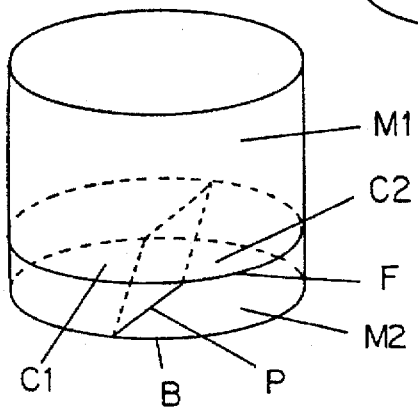

FIG. 14 represents a section in three dimensions of a jacket whose upper open part M1 is intended to receive the bottom of the container to be illuminated and is separated by a wall F allowing passage of the light coming from the lower part M2, consisting of two compartments C1 and C2 containing the reactants and separated from each other by a wall P, oblique in relation to the vertical, which is breakable by a lateral or shearing movement of the flexible base B.

Figure 15A:
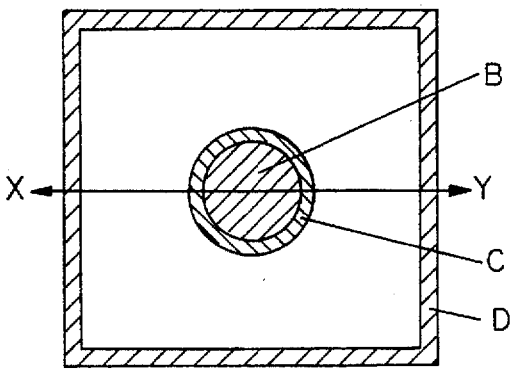
Figure 15:
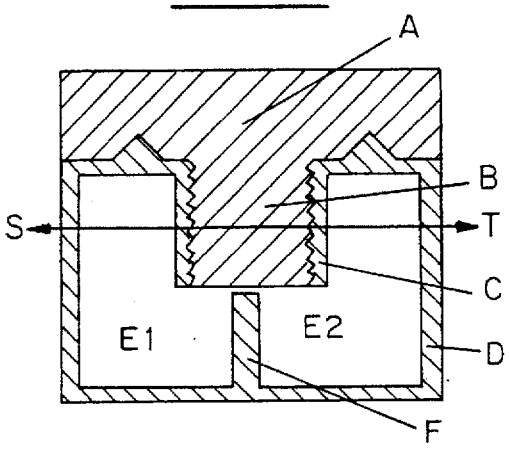

FIG. 15, representing a small cubic container constituting an "unscrewable extemporaneous device" is a front view of the section in the plane XY of the attached FIG. 15A, which represents the section of the device viewed from above in the plane ST of the same FIG. 15. In these two FIGS. 15 and 15A, the stopper A extends by the threaded part B into the neck C penetrating into the bottle part D, divided into two compartments E1 and E2 separated by the wall F. FIG. 15 shows the "device" with its stopper closed: the threaded part B of the stopper A presses onto the central part of the wall F and therefore hermetically separates the two compartments E1 and E2 of the bottle part, thus preventing the mixing of the reactants contained in the compartments.

Figure 16A:
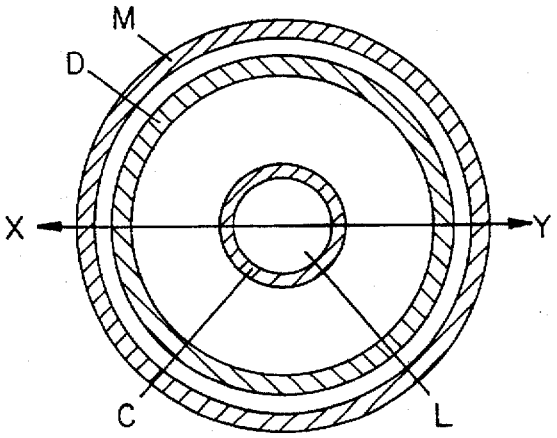
Figure 16:
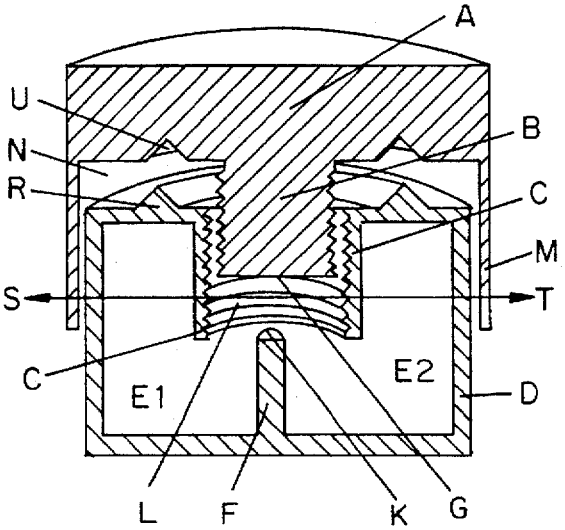

FIGS. 16 and 16A represent a small cylindrical container constituting an "unscrewable extemporaneous device" whose stopper has been partly unscrewed. FIG. 16 is a view in three dimensions of a section in the plane XY of the attached FIG. 16A, itself representing a diagrammatic section viewed from above in the plane ST of the same "device". In these two figures, the stopper A extends by the screwed part B into the neck C penetrating into the bottle part D divided into two compartments E1 and E2 separated by the wall F. The base G of the threaded part B of the stopper A, now separated from the surface K of the upper edge of the wall F by the unscrewing of the stopper A, here allows the reactants coming from the compartments E1 and E2 to pass into the chamber L thus opened. The external diameter of the stopper A is a little wider than that of the bottle part B and its external edge descends in a circular skirt M around the bottle D which it continues to cover even when the stopper A is partially unscrewed. This skirt M covers and hides from view the open part N which is formed between the bottle and the stopper A by the unscrewing of the latter. Projections R on the top of the bottle D corresponding to indentations U in the stopper A permit a better airtightness when the stopper is closed.

Figure 17:
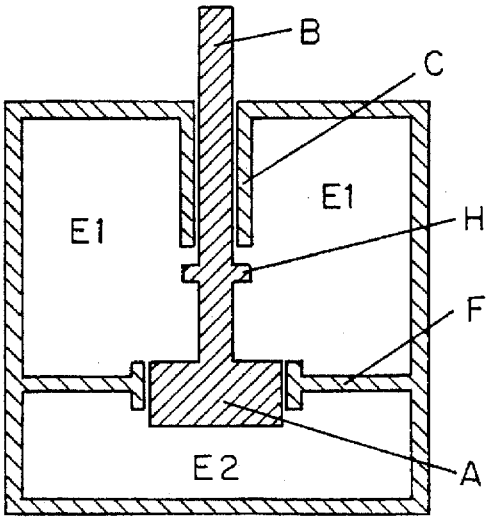
Figure 17A:
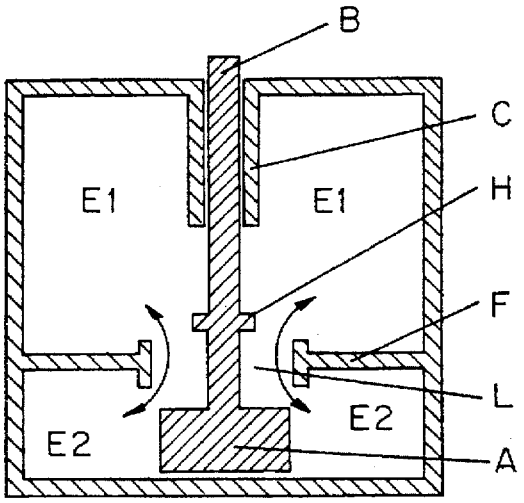

FIGS. 17 and 17A represent a small cubic container constituting an "extemporaneous device" before (FIG. 17) and after (FIG. 17A) the activation of the chemiluminescence, that is to say when the reactants previously isolated have been mixed. FIGS. 17 and 17A represent sections made in a plane parallel to the directions passing through the middle of the container when the latter is held in such a way that the two compartments E1 and E2 are superposed. The stopper A which blocks the hole L made in the wall F separating the two compartments E1 and E2 is controlled by a rod B which leaves the container sliding in the tube C attached to the upper wall of the container. This rod bears ridges H preventing the accidental return of the rod and the consequent departure of the stopper A from the hole L which it blocks.

Figure 18:
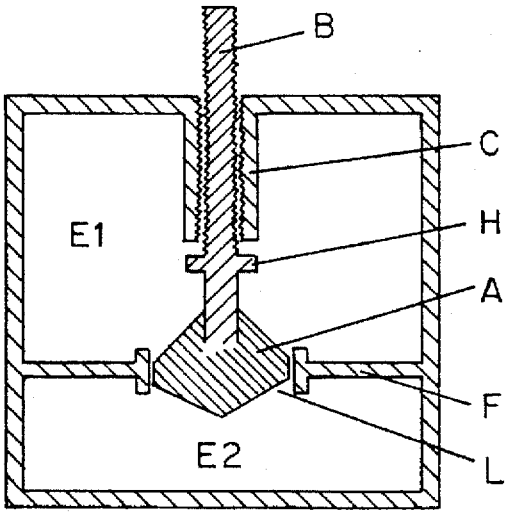

FIG. 18 represents, according to the same section as for FIGS. 17 and 17A, a small cubic container constituting an "unscrewable extemporaneous device". It is comparable to that of FIGS. 17 and 17A but differs by the fact that the rod B which controls the stopper A for removing it from the hole L, which it blocks, is threaded and moves in the tube C, having a corresponding thread, by screwing and unscrewing. On screwing it, therefore, the stopper A can be made to leave downwards and thus open the hole L, accordingly permitting the mixing of the reactants. If it is unscrewed, the stopper A can be raised again and the hole L blocked again. It can also be screwed gently and the mixing of the reactants thus limited. The stopper A is here formed from two inverted cones joined together at the base so as to facilitate its return to the hole L in case of restopping. Here also the ridges H prevent the stopper A from leaving the hole L and from being raised too high.

Figure 19:
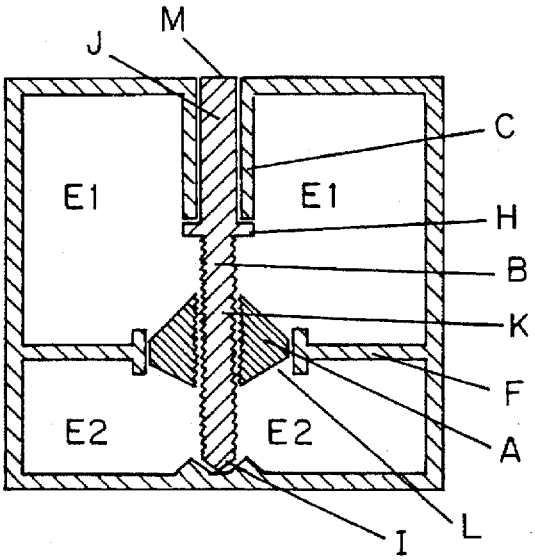

FIG. 19 represents, according to the same section as for FIGS. 17, 17A and 18, a small cubic container constituting an "unscrewable extemporaneous device". It is comparable with those of these figures but here the removal of the stopper A from the hole L which it blocks, or its return, is controlled by the screwing or unscrewing of a threaded rod B which turns freely at its lower end in the cavity I made in the internal face of the lower wall of the container; the upper part J of this rod B is non-threaded and turns freely in the tube C. The central part K of the control rod is threaded and fits into the axis, likewise threaded, of the stopper A. When this rod is turned by action on its top end M emerging from the container, the ridges H prevent it from rising and it is the stopper A, threaded along its vertical axis, which leaves or returns to the hole B which it closes.

FIG. 20 represents a median section of a recipient (beaker) having a bottom provided with a recess P with vertical axis, open downwardly, into which there fits a container constituting a source of chemiluminescent light U.

This container is kept in place by its own elasticity against the walls of the recess which has ridges R exerting a positive thrust against the container U to ensure its retention. There are also ridges S in the ceiling W of the recess touching the light source. These ridges S as well as the lateral ridges R collect the light towards the walls of the recipient. In the wall of the zone V containing the drinking liquid there is a shoulder T supporting an engraved advertising text.

FIG. 20A is a section of the base of the recipient (beaker) at the level of the ceiling W of the recess P according to the axis 20A—20A. Here can be seen ridges S collecting the light and the spaces O between these ridges.

FIG. 20B is a section in the base of the recipient (beaker) according to the axis 20B—20B showing the recess P and the relief of the lateral ridges R pressing on the chemiluminescent container U and collecting its light.

Of course, the present invention is not limited to the embodiments described and variants can well be envisaged without departing from the framework of the present patent.

I claim:

1. Apparatus comprising a container with at least partially transparent or translucent walls for containing a liquid, and a chemiluminescent light source, said light source comprising a tight envelope, transparent or translucent, containing appropriate reactants producing the chemiluminescence, wherein said container has a bottom portion for receiving said envelope, said envelope being exclusively surrounded by a material of said bottom portion so as not to affect a capacity of said container.

2. Apparatus as recited in claim 1 wherein the envelope is integral with the bottom portion of the container and is at least partially transparent or translucent.

3. Apparatus as recited in claim 2 in which the container has the form of a cylindrical or truncated conical jacket closed at its base for facilitating stacking a plurality of containers, said container being used as a drinking beaker and having walls which are extended upwardly, said apparatus having a closed compartment at said bottom portion thereof containing the reactants as a premixed and deep-frozen chemiluminescent liquid, said closed compartment separated, by a wall which allows the light to pass, from an open part of the container that contains the liquid to be illuminated, the liquid being illuminated when the deep-frozen luminescent mixture heats up after having been withdrawn from a deep-freezing chamber where it has been preserved.

4. Apparatus according to claim 1, in which the container comprises a beaker, said bottom portion of said container comprises a base which is at least partially transparent or translucent, said base having a hollowed-out recess therein for receiving said envelope.

5. Apparatus according to claim 4, wherein said recess has a vertical axis, said recess opening downwardly, for accommodating said chemiluminescent light source, wherein said envelope has a shape corresponding to that of the recess, said chemiluminescent light source kept in place by its own elasticity against lateral walls of the recess, said recess having ridges (R), said ridges exerting a positive thrust against the envelope thereby ensuring its support and, in addition, collecting the chemiluminescent light to transmit in the walls of the beaker.

6. Apparatus according to claim 5, wherein said container comprises a horizontal wall at a top portion of the recess and separating the recess from a cavity of the beaker for containing a drink, said horizontal wall having ridges (S) for entering into close contact with the container and collecting the chemiluminescent light.

7. Apparatus according to claim 5, wherein the recess in said base has a shape of an internal screw thread for engaging a chemiluminescent element specially manufactured in the form of a large screw for insertion therein, said chemiluminescent element having a volume and surface adapted to close association with the beaker.

8. Apparatus according to claim 1, in which the envelope comprises a container formed of two superposed compartments (E1, E2) containing the reactants whose mixing induces the chemiluminescence and separated by a partition (F) pierced by a hole (L) closed by a stopper (A) coupled to a control rod (B) having a diameter smaller than a diameter of the stopper, the control rod leaving the container by sliding in a tubular reinforcement (C) inside the container and joined to an external wall thereof in order to be pushed to permit disengagement of the stopper (A) from the hole (L) which it blocks and therefore to enable communication between the two compartments and to enable mixing of the two liquids.

9. Apparatus according to claim 8, modified in that the control rod (B) of the stopper and the tube (C), integrally attached to the upper wall in which it moves, each has a corresponding screw thread permitting the rod to be screwed to release the stopper downwardly from the hole which it closes and to be unscrewed upwards so as to re-close the hole in order to permit only a partial mixing of the reactants, the stopper having the form of a sphere or of two cones integrally attached by their base.

10. Apparatus according to claim 9, modified in that the stopper (A) has a threaded axis through which passes vertically a threaded rod (K), this rod turning freely at a bottom end thereof in a cavity (1) of the internal face of the lower wall of the container while an upper, non-threaded end thereof fits in the tube (C) with smooth interior fixed to the upper wall, wherein a head portion of the rod appears by emerging at the external surface of the upper wall of the container, from which it can be screwed or unscrewed, then causing the stopper to leave, by the effect of the screwing in its threaded channel, of the hole which it closes, permitting the communication of the two compartments and mixing and control of the amount of mixing of the reactants, the upper part (J) of the rod bearing ridges (H) before entering the smooth tube, in order that it does not leave the cavity in which its lower end turns freely.

11. Apparatus according to claim 1, in which the envelope has a form of a column divided into two parts (A, D) of which an upper one is a stopper (A) that can be turned, the stopper having a threaded part (B) which turns in a neck (C) arranged in a lower part forming a bottle (D), which comprises a chamber, the chamber divided into two compartments (E1, E2) containing the reactants, whose mixing induces the chemiluminescence, by a partition (F) on an upper edge of which there presses firmly a base (G) of the threaded part (B) of the stopper (A) which, in being partially unscrewed, produces in the neck above the separating wall (F) and below the base of the threaded part of the stopper an empty space where the reactants can be caused to mix.

12. Apparatus according to claim 2, in which the envelope is in the form of a jacket intended to receive a container, separated, by a partition (F) allowing the light to pass, from a double lower chamber (M2) containing in each of the compartments (C1, C2) one of the reactants for extemporaneous mixing, and wherein a floor of a base of the jacket is of a flexible material, the two compartments of the double lower chamber being separated by a wall (P) that is horizontal or inclined to the horizontal and that can be broken or punctured by one or more points (A) situated on the flexible base.

13. Apparatus according to claim 2, in which the envelope is in the form of a jacket intended to receive a container, separated, by a partition (F) allowing the light to pass, from a double lower chamber (M2) containing in each of the compartments (C1, C2) one of the reactants for extemporaneous mixing, and wherein a floor of a base of the jacket is of a flexible material, the two compartments (C1, C2) of the lower chamber (M2) are separated by a wall (P) that is vertical or oblique in relation to the vertical and can be broken by a lateral movement or shearing movement of the flexible base.

14. Apparatus according to claim 2, in which the envelope containing the reactants is integrated into the volume of the bottom portion of the container from which it can not be separated, thereby providing a compact assembly.

15. Apparatus comprising a container with at least partially transparent or translucent walls for containing a liquid, and a chemiluminescent light source, said light source comprising a tight envelope, transparent or translucent, containing appropriate reactants producing the chemiluminescence, characterized in that the container has a bottom intended to receive the envelope which is exclusively surrounded by the material of the bottom so as to not affect the capacity of the container, wherein said envelope has a form of a small container having two compartments containing the reactants, an internal wall between the two compartments, and external walls of a material with a flexibility adapted to its use, one of said external walls having at least one point on an internal surface thereof for puncturing said internal wall wherein said internal wall has, at places corresponding to the at least one point, zones of fragility facilitating piercing by said at least one point, thereby enabling puncturing of said internal wall separating the two compartments containing the reactants whose mixing induces the chemiluminescence by applying pressure to said external walls.

16. Apparatus comprising a container with at least partially transparent or translucent walls for containing a liquid, and a chemiluminescent light source, said light source comprising a tight envelope, transparent or translucent, containing appropriate reactants producing the chemiluminescence, characterized in that the container has a bottom intended to receive the envelope which is exclusively surrounded by the material of the bottom so as to not affect the capacity of the container, wherein said envelope has a form of a small container comprising two compartments having external walls and including an internal wall therebetween and separating the two compartments (C1, C2) constituting the container and containing the reactants whose mixing induces the chemiluminescence, said internal wall having at least one zone of fragility facilitating its breakage by pressure or shearing movement of the external walls.

17. Apparatus comprising:

a container for containing a liquid, said container further including:

walls, said walls having at least a partially light transmitting characteristic, and a chemiluminescent light source, said chemiluminescent light source comprising:

an envelope having at least a partially light transmitting characteristic, said envelope containing reactants for inter-acting with each other to produce chemiluminescence;

wherein said container has a bottom portion, separated from said liquid containing portion and having a hollowed portion shaped for receiving said envelope so that said envelope is surrounded thereby so as to avoid affecting the capacity of the liquid containing portion of said container.

18. The apparatus recited in claim 17, wherein said container comprises translucent walls.

19. The apparatus recited in claim 17, wherein said container comprises transparent walls.

20. The apparatus recited in claim 17, wherein said reactants in the envelope are at a predetermined temperature, in a mixed state, and in a non-interacting state in which said chemiluminescence is prevented by said predetermined temperature.

21. The apparatus recited in claim 17, wherein said envelope comprises separate interconnectable compartments containing reactants for producing said chemiluminescence at a time of use.

22. The apparatus recited in claim 21, wherein said envelope comprises: an interior wall separating said interconnectable compartments and external walls, wherein said external walls are flexible and at least one external wall includes at least one projection therefrom, said interior wall having at least one frangible zone opposite each said projection thereby to provide for puncturing said internal wall by said projection responsive to flexing of said external walls by application of pressure thereto.

23. The apparatus recited in claim 21, wherein said envelope comprises: an interior wall separating said interconnectable compartments and external walls, wherein said interior wall has at least one frangible zone thereby to provide for breakage of said internal wall responsive to application of pressure or shearing movement to said external walls.

24. The apparatus recited in claim 17, wherein said envelope contains said reactants in a premixed format at a temperature outside a range of chemiluminescence thereof.

* * * * *